United States Patent [19]

Hafner

[11] Patent Number: 4,607,418

[45] Date of Patent: Aug. 26, 1986

[54] MEANS FOR INTERLOCKING OVERLAPPING SHEET MATERIAL

[76] Inventor: Otto P. Hafner, 1321 Paddock Way, Cherry Hill, N.J. 08034

[21] Appl. No.: 553,140

[22] Filed: Nov. 18, 1983

[51] Int. Cl.[4] ..... B23P 17/00

[52] U.S. Cl. ..... 29/21.1; 29/432; 29/509; 29/521; 29/715; 29/243.5

[58] Field of Search ..... 29/432, 432.1, 509, 29/521, 798, 21.1, 716, 714, 715

[56] References Cited

U.S. PATENT DOCUMENTS 3,022,687 2/1962 Richards ..... 29/432.1 UX 3,934,327 1/1976 Hafner ..... 29/509 X 4,173,815 11/1979 Lux et al. ..... 29/432.1

4,184,396 1/1980 Hafner ..... 29/432.1 X

*Primary Examiner*—Charlie T. Moon

*Attorney, Agent, or Firm*—Austin R. Miller

[57] ABSTRACT

A device for fastening superimposed sheets of metal or the like together by punching corresponding portions of the sheets into displaced positions relative to the adjacent areas of the sheets, then spreading one displaced portion of one sheet, under pressure, into interlocking engagement with the adjacent areas of the other sheet while retaining the corresponding displaced portion of the other sheet from spreading under the same pressure.

17 Claims, 8 Drawing Figures

MEANS FOR INTERLOCKING OVERLAPPING SHEET MATERIAL

This invention relates to a method and means for attaching overlying sheets of deformable metal, or the like to each other, and it particularly relates to a method and means for achieving the aforesaid purpose without requiring the use of rivets, bolts, screws or any other extraneous elements.

It has, heretofore, been known to attach two or more deformable sheets together by cutting or punching mating portions of the sheets into displaced positions relative to the adjacent areas of the sheets, and then swaging or flattening at least one of the displaced portions so that they form interlocking elements between the sheets. Illustrative of such methods of attachment are prior U.S. Pat. Nos. 3,885,299, 3,934,327, 3,924,378, 3,981,064 and 3,900,937.

However, the devices disclosed in the prior art were generally quite complex, heavy and bulky and were also relatively expensive, so that they were somewhat limited in their use. Furthermore, in some instances, the prior devices required the swaging or flattening of both displaced portions (i.e. the corresponding displaced portions of both the upper and lower sheets). This not only required the expenditure of a relatively large amount of energy, but, since one of these swaged portions covered the other, and since only the covered swaged portion provided the actual locking or fastening effect, that portion could not be readily spread controlled or inspected to ensure that it was satisfactory. Indeed, the spreading of the superfluous portion, by absorbing some of the energy input, often tended to interfere with the effective spread of the locking portion under the force exerted thereon. In addition, since both displaced portions were spread under the applied pressure, due to the process used, both became thinned out, often resulting in the development of a significant air space between the displaced portion and the adjacent area of the corresponding sheet, and this caused the resultant joint to be loose. Alternatively, if it was attempted to avoid the air space, the process would result in distortion of the joint.

It is, therefore, an object of this invention to overcome the disadvantages and defects of the prior art by providing an attaching device for superimposed sheet material that is relatively simple in construction, light in weight, flexible or versatile and relatively inexpensive to produce.

Another object of the present invention is to provide a device of the aforesaid type which effects a tight joint between the attached sheets.

Another object of the present invention is to provide a device of the aforesaid type which requires a minimum energy input.

Another object of the present invention is to provide a method of effecting s secure joint between overlying deformable sheets which comprises discrete steps, thereby avoiding simultaneous movement of different parts to effect one operation while the machine is under the load of effecting another operation, which would require a relatively large input of energy at one time.

Other objects and many of the attendant advantages of the present invention will be readily appreciated as the same becomes better understood by reference to the following description when read in conjunction with the accompanying drawings wherein.

Figure 1:
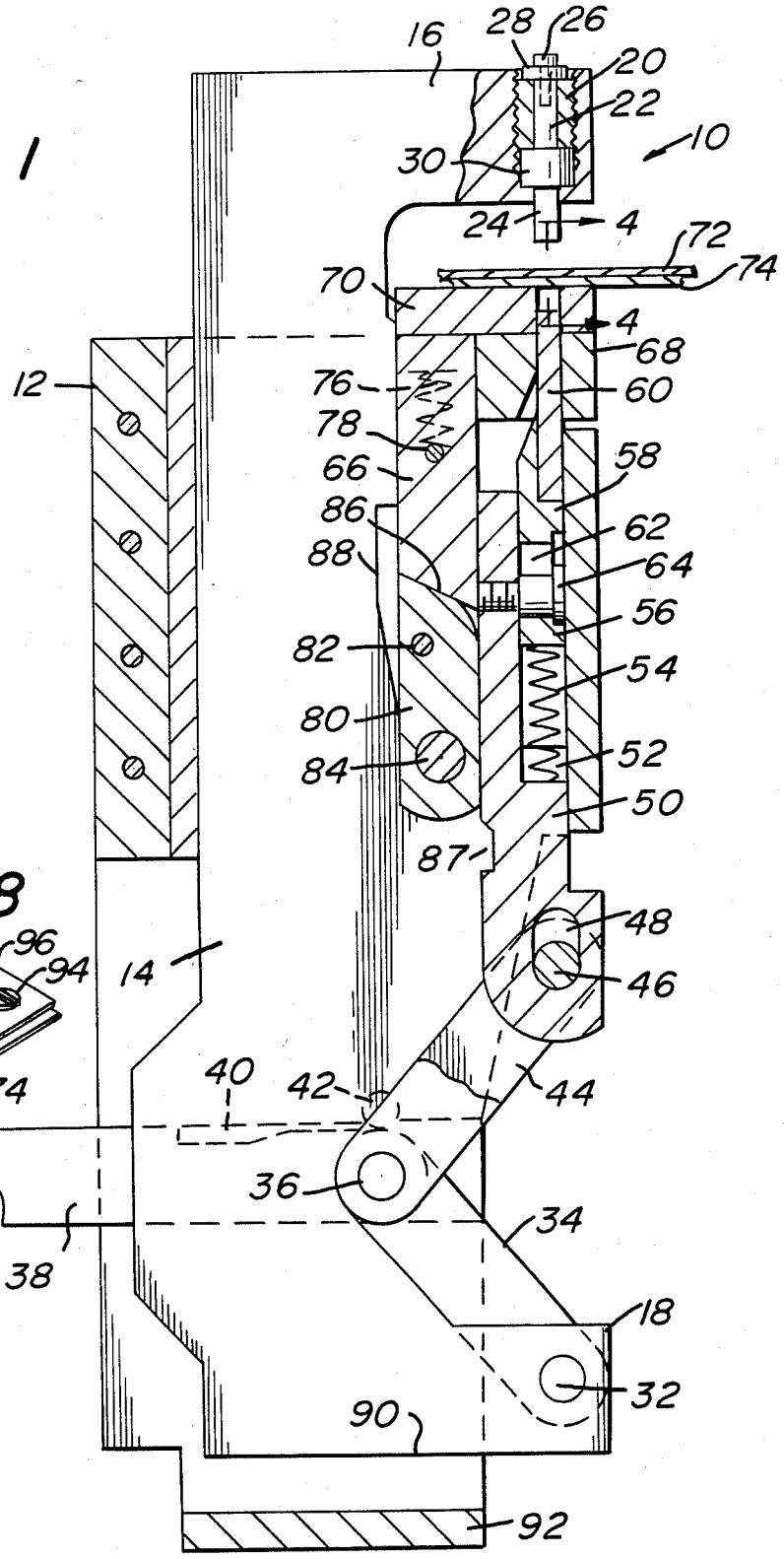
FIG. 1 is a sectional view of a machine embodying the present invention with the punch and anvil in retracted position and with superimposed metal sheets in position to be acted upon.

Referring now in greater detail to the figures of the drawings wherein similar reference characters refer to similar parts, there is shown an attaching machine, generally designated 10, which comprises a housing 12 in which is vertically slidable a block 14 having an upper lateral flange 16 and a bottom lateral flange 18. The flange 16 is provided with a vertical, threaded bore in which is threadedly positioned a bushing 20 through which extends the shaft 22 of a punch 24, the shaft 22 being held in position in the bushing by a bolt 26 and nut 28 at its upper end and having a collar 30 at its lower end integral with the punch 24.

Figure 2:
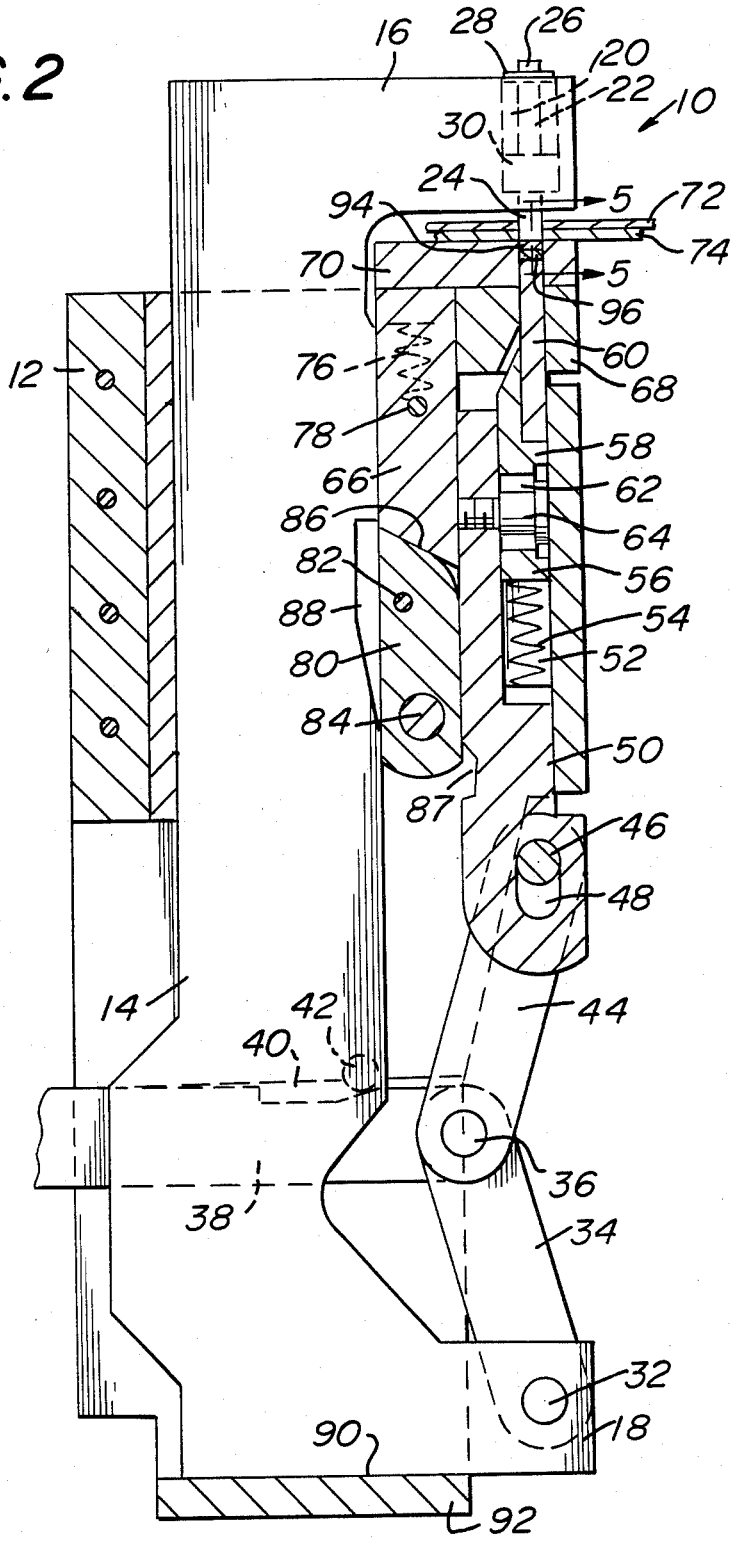
FIG. 2 is a sectional view similar to FIG. 1 but with the punch in piercing and displacing position.
Figures 3, 4, 5, 6, 7:
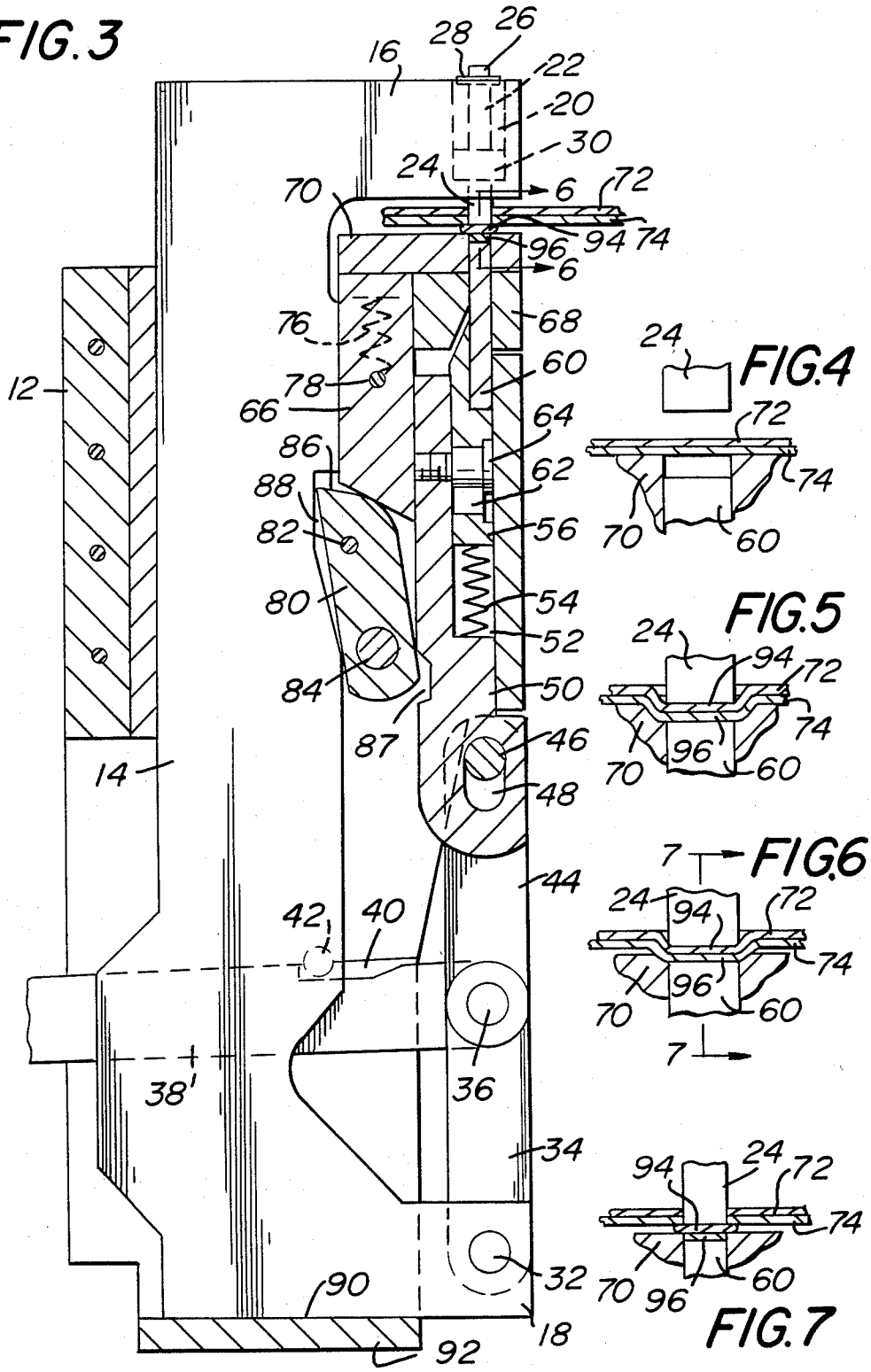
FIG. 3 is a sectional view similar to FIGS. 1 and 2 but with the punch and die in flattening position.
FIG. 4 is a sectional view taken on line 4—4 of FIG. 1.
FIG. 5 is a sectional view taken on line 5—5 of FIG. 2.
FIG. 6 is a sectional view taken on line 6—6 of FIG. 3.
FIG. 7 is a sectional view taken on line 7—7 of FIG. 6.

The lower flange 18 of the block 14 is provided with a pin 32 upon which pivots a link 34 having its opposite end pivotally connected by a pin 36 to a drive arm 38. The arm 38 is, itself, connected to a power source (not shown) which may be a pneumatically or hydraulically actuated piston or any other desired mechanical or electrical drive means which drives the arm to move or reciprocate in the longitudinal direction as shown in FIGS. 1, 2 and 3. The arm 38 is provided with a longitudinal slot or recess 40 adapted to receive a pin 42 extending from a side of the housing. The pivot pin 36 also supports one end of a link 44, the opposite end of which is connected to a pivot pin 46 movable in a slot 48 of a block 50 to form a lost motion or dwell connection therewith.

The block 50 is vertically slidable in the housing 12 and is provided with a vertical slot 52 in which is positioned a spring 54 bearing against a wall 56. The wall 56 defines the lower end of a slidable block 58 in the upper end of which is fixed a plunger or anvil 60. The wall 56 also defines a slot 62 in the block 58 and this slot is adapted to slidably receive a shoulder bolt 64 that extends from the block 50. The bolt 64 acts as a limit stop for upward movement of the block 58 under pressure of the spring 54.

Slidably positioned in the housing 12, adjacent the block 50, is a block 66 having a lateral die holder 68 extending laterally therefrom into a position overlying the block 58. A die 70 is mounted on the die holder 68. The holder 68 has a bore which mates with a corresponding bore in the die 70 and slidably positioned in these mating bores is the anvil 60, in alignment with the punch 24.

Adapted to be removably positioned on the die 70 are shown a pair of metal plates 72 and 74, the plate 72 being superimposed on the plate 74. These plates comprise the workpieces to be fastened together.

The block 66 is spring biased downwardly by a spring 76 bearing on a pin 78 extending between the side walls of the housing 12. The block 66 is adapted to be held in its upper position by a latch 80 which is mounted on a latch control pin 82 connected to the housing, and is pivotally mounted in the housing by pivot pin 84. The latch 80, which has a curved bearing edge 86, normally holds the block 66 against downward movement because the latch is held upright between the block 14 and the block 50. However, when the block 50 is moved upwardly a sufficient amount to expose a recess 87 provided at the lower portion of the block 50, the lower end of the latch 80 can pivotally move into the recess 87 under pressure of the spring 76. In doing so, the upper portion of the latch moves into a recess 88 provided in the block 14.

In operation, with the punch 24 in retracted position, as shown in FIG. 1, the workpieces 72 and 74 are placed onto the die 70. This may be done either manually, by conveyor or in any other desired manner. The drive arm 38 is then moved to the right, as shown in FIG. 2. As it moves to the right, the toggle links 34 and 44 begin to assume the more vertical position and the pin 46 moves upwardly in the slot 48. The continued movement of the drive arm 38 causes the pivot pin 32 to move the bottom end 90 of the block 14 against the bottom 92 of the housing 12, as shown in FIG. 2. This downward movement of the block 14 causes the punch 24 to move down and punch through the plates 72 and 74, displacing the respective portions 94 and 96.

After the downward movement of the punch 24 there is a dwell period until the pin 46 contacts the upper end of the slot 48. Thereafter, as the drive arm 38 continues to move to the right, the links 34 and 44 move toward the vertical position. This causes the block 50 to move up, compressing the spring 54. As the block 50 moves up, it brings the recess 87 into juxtaposition with the lower end of the latch 80. This permits the spring 76 to move the block 66 downward against the pivoting action of the latch 80, as shown in FIG. 2. The downward movement of the block 66 lowers the die holder 70 just sufficient to expose only the displaced portion 94, the displaced portion 96 still being within the bore in the die 70.

Figure 8:
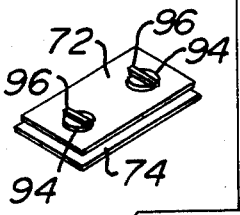
FIG. 8 is a perspective view showing the interlocking joints between two plates.

When the linkage reaches its full vertical position, as shown in FIG. 3, the anvil 60 is exerting full pressure against the lower displaced portion 96 while the punch 24 is exerting full pressure against the upper displaced portion 94. Since only the portion 94 is now free to expand underneath the lower plate 74, it thereby locks the upper plate 72, from which it is displaced, to the lower plate 74. The displaced portion 96 has no locking action, in itself, but underlies the expanded portion 94 as a sort of bridge element. This is best seen in FIG. 8. In this position the pin 42 bears against the rear edge of the slot 40 so that the drive arm is prevented from further movement to the right, and the links are, therefore, retained in full vertical position.

After completion of the interlocking action, the drive arm 38 is moved to the left. The pin 46 then moves down through its lost motion connection and when it reaches the bottom of the slot 48, the block 50 moves down. The compressed spring 54 thereupon pushes the block 58 up, carrying the anvil 60 upwardly with it. The anvil, thereupon, lifts the displaced portion 96 out of the bore in the die 70 in a stripping action, clearing the machine for the next action.

The drive arm 38 is reciprocated in timed relation to the type of workpieces being acted on, any standard desired type of timing means being utilizable.

The punch 24 is longitudinally adjustable by means of the screw-threaded busing 20 so that its position may be varied in accordance with the thicknesses of the workpiece. The clearance provided before the flattening movement may also be varied by varying the distance traveled by the pin 82.

Although the plates 72 and 74 are metal plates, the invention is adapted to be used with any expandable type materials that can be flattened under pressure.

The invention claimed is:

1. Apparatus for forming interlocking joints between superimposed sheets of deformable material comprising a movable punch holder having a shearing and deforming punch extending therefrom, a die in opposed relation to said punch, said die being adapted to support said superimposed sheets of deformable material and having an aperture therein in aligned relation to said punch, a movable anvil within said aperture, means for moving said punch holder in one direction for moving said punch against said superimposed sheets while supported by said die, said punch being constructed and arranged to exert pressure against corresponding portions of said sheets to shear and deform said portions into said aperture upon movement of said punch holder in said one direction, means for moving said anvil towards and within said aperture in a "direction opposite" from said one direction of punch movement;

means operatively connected to said die to move said die away from said punch in response to anvil movement in said opposite direction past a predetermined point, whereby one of the displaced portions becomes positioned above said aperture while the other of said portions remains within said aperture, said anvil moving means then moving said anvil against said displaced sheared and deformed portions whereby opposed pressure of said punch and anvil causes the displaced portion above said aperture to expand against the corresponding surface of the adjacent sheet.

2. The apparatus of claim 1 wherein said punch is longitudinally adjustable toward and away from said die.

3. The apparatus of claim 1 wherein means are included to provide a dwell period between movements of said punch toward and away from said superimposed sheets on said die.

4. The apparatus of claim 1 wherein said punch holder is a block movable within a housing, and said means for moving said punch holder comprises toggle linkage operatively connected to a power source for activating said linkage.

5. The apparatus of claim 4 wherein said linkage includes a lost motion connection which provides a dwell period between movements of said punch toward and away from the superimposed sheets on said die.

6. Apparatus for forming interlocking joints between superimposed sheets of deformable material comprising a movable punch holder having a shearing and deforming punch extending therefrom, a die in opposed relation to said punch, said die being adapted to support said superimposed sheets of deformable materials and having an aperture in aligned relation to said punch, an anvil movable within said aperture, means for moving said punch in one direction against said superimposed sheets while said sheets are supported by said die, said punch being constructed and arranged to exert pressure against corresponding portions of said sheets to shear and deform portions into said die aperture upon movement of said punch holder in said one direction, means for moving said anvil towards and within said aperture in a direction opposite from said one direction of punch movement;

means operatively connected to said die to move said die away from said punch whereby one of the sheared and deformed sheet portions becomes positioned above said aperture while the other of said sheet portions remains within said aperture, said anvil moving means then moving said anvil against said displaced sheared and deformed potions whereby opposed pressure of said punch and anvil causes the displaced portion above said aperture to expand against the corresponding surface of the adjacent sheet;

wherein said anvil is biased toward such punch and retaining means are provided for retaining said anvil against its bias until after the displaced portion above said aperture has been expanded, and means for releasing said retaining means to permit said anvil to move toward said punch after said displaced portion above said aperture has been expanded, whereby the displaced portion within said aperture is pushed out of said aperture in a stripping action.

7. The apparatus of claim 6 wherein said die is restrained against movement away from said punch by a latch means, said latch means being movable away from latching position when said anvil is moved toward said punch.

8. Apparatus for forming interlocking joints between superimposed sheets of deformable material by affecting relative movement between a punch and said superimposed sheets while said sheets facingly contact an apertured die aligned with said punch to shear and deform by punch-displacing superimposed sheet portions into said die aperture, with relative movement between said die and said displaced sheet portions exposing part of said displaced sheet portions outwardly of said aperture, with compression of said displaced sheet portions between an anvil and said punch laterally spreading said exposed part of said displaced sheet portions over a surface of the superimposed sheets adjacent said die, comprising:

(a) a movable punch holder having a shearing and deforming punch extending therefrom, (b) a die in opposed relation to said punch, (c) said die being adapted to support said superimposed sheets of deformable materials and having an aperture in aligned relation to said punch, an anvil movable within said aperture, (d) means for pressing together said punch and said superimposed sheets facingly contacting said die, thereby shear and deform by punch-displacing portions of said sheets into said die aperture, (e) means for moving said anvil toward said punch and into said aperture to sandwich said displaced sheet portions in said aperture between said anvil and said punch;

(f) means, responsive to anvil movement, for moving said die with respect to said sandwiched displaced sheet portions and exposing at least some of said sandwiched displaced sheet portions out of said aperture for spreading thereof over a surface of said superimposed sheets in response to force exerted between said punch and said anvil on said sandwiched displaced sheet portions.

9. Apparatus of claim 8 wherein said means for moving said die with respect to said sandwiched displaced sheet portions moves said die axially with respect to said aperture and operates in response to movement of the anvil past a fixed position.

10. Apparatus of claim 9 wherein said die moving means is a spring-loaded latch.

11. Apparatus of claim 9 wherein said die moving means operates in response to contact thereof by a control surface of said anvil moving towards said punch.

12. Apparatus of claim 8 wherein said anvil moving means operates responsively to and after motion of said means for pressing together said punch and said superimposed sheets.

13. Apparatus for forming interlocking joints between superimposed sheets of deformable material by affecting relative movement between a punch and said superimposed sheets while supported by an apertured die axially aligned with said punch with force exerted by said punch against said sheets shearing, deforming and displacing sheet portions into said die aperture, by thereafter contacting said displaced sheet portions within said aperture with an anvil opposing said punch thereby holding said displaced portions between said punch and said anvil, by thereafter affecting relative movement between said die and said punch to expose a partial thickness of said displaced sheet portions out of said die aperture to laterally spread said exposed displaced sheet portions at said surface of the adjacent superimposed sheets, comprising:

(a) a moveable punch holder having a shearing and deforming punch extending therefrom, (b) a die in opposed relation to said punch, (c) said die being adapted to support said superimposed sheets of deformable materials and having an aperture in aligned relation to said punch, an anvil movable within said aperture, (d) means for moving and maintaining said punch against said superimposed sheets as said sheets facingly contact said die thereby punch displacing superimposed portions of said sheets into said die aperture;

(e) means, operative in response to movement of said punch, shearing, deforming and displacing superimposed portions of said sheets into said die aperture, for moving said anvil towards and into said aperture to contact said sheet portions displaced thereinto by said punch upon completion of punch movement in a first direction towards said superimposed sheets;

(f) spring loaded latch means, responsive to movement of said anvil moving means past a predetermined point, for moving said die axially with respect to said anvil thereby exposing at least one sheet portion of said displaced superimposed sheet portions out of said die aperture for transverse spreading thereof along a surface of said superimposed sheets adjacent said die in response to force exerted between said punch and said anvil on said displaced sheet portions, said spring loaded latch means contacting said anvil moving means and moving in camming action in response to contact of a control surface of said anvil moving means with said latch means.

14. Apparatus of claim 13 wherein said die moving means further comprises:

a latching member rotatable about a pivot in response to contact thereof by a control surface of said anvil movement means; a spring loaded member supporting said die and biased against said latching member by said spring; and means biasing said die supporting member against said latching member for moving said latching member rotatably about said pivot and thereby moving said die supporting member and said die in response to contact of said latching member by said control surface of said anvil support means.

15. Apparatus of claim 14 wherein said control surface moves against said latching member parallel with direction of travel of said anvil.

16. Apparatus of claim 15 further comprising means for delaying movement of said anvil with respect to said displaced superimposed sheet portions upon completion of punch movement towards said superimposed sheets.

17. Apparatus of claim 16 wherein said means for moving said punch and said means for moving said anvil operate responsively to one stroke of a reciprocating member.

* * * * *